United States Patent [19]

Langenfeld et al.

[11] Patent Number: 4,538,955

[45] Date of Patent: Sep. 3, 1985

[54] ADJUSTABLE TOWER FOR FRONT END TRACTOR LOADERS

[75] Inventors: Joseph W. Langenfeld; Neal W. Westendorf, both of Onawa, Iowa

[73] Assignee: Westendorf Mfg. Co., Ltd., Onawa, Iowa

[21] Appl. No.: 546,902

[22] Filed: Oct. 31, 1983

[51] Int. Cl.[3] ..... E02F 3/62

[52] U.S. Cl. ..... 414/686; 414/697; 414/722

[58] Field of Search ..... 414/722, 697, 686

[56] References Cited

U.S. PATENT DOCUMENTS

| | | | |
|---|---|---|---|
| 2,815,876 | 12/1957 | Rogers | 414/686 |
| 4,049,140 | 9/1977 | Roose | 414/722 X |
| 4,051,962 | 10/1977 | Westendorf | 414/686 |
| 4,345,870 | 8/1982 | Anderson et al. | 414/686 |

*Primary Examiner*—Robert J. Spar
*Assistant Examiner*—Donald W. Underwood
*Attorney, Agent, or Firm*—Zarley, McKee, Thomte, Voorhees & Sease

[57] ABSTRACT

An adjustable tower for front end tractors comprising first and second tower members adapted to be secured to opposite sides of the tractors. Side frame members extend forwardly from each of the tower members and have downwardly extending cylindrical front end portions provided thereon. A length-adjustable cross member is secured to the forward ends of the side frame members and extends therebetween for connection to the forward end of a tractor. A pair of booms are secured at their rearward ends to the upper ends of the first and second tower members and are adapted to receive a materials-handling attachement thereon.

3 Claims, 3 Drawing Figures

ADJUSTABLE TOWER FOR FRONT END TRACTOR LOADERS

BACKGROUND OF THE INVENTION

Front end loaders have long been used on tractors for material-handling operations. The early front end loaders were permanently mounted on the tractors which interfered with the usefulness of the tractor during operations when the front end loader was not needed. Westendorf U.S. Pat. No. 3,324,954 disclosed a front end loader which could be quickly mounted on the tractor and removed therefrom during periods of non-use. Another type of tractor loader is disclosed in U.S. Pat. No. 4,051,962.

In all of the front end loaders adapted for quick attachment and quick detachment, a pair of upright tower members are provided having forwardly extending side frame members secured thereto. A cross member is rigidly secured to the forward ends of the side frame members and extend therebetween. Thus, the predetermined length of the side frame members and their horizontal spacing required that a wide variety of models be provided to fit the various tractors on the market.

A tremendously large number of smaller tractors having horsepower in the range of between 17 and 35 have become available. Each of the smaller tractors has a different configuration and it is very difficult to provide a front end loader which will fit the particular tractor let alone a number of tractors. For example, some of the small tractors have mufflers positioned at the side of the tractor which interfere with the mounting of a loader on the tractor. Further, some of the tractors have various front end configurations which also interfere with the mounting of a loader thereon.

SUMMARY OF THE INVENTION

An adjustable tower for front end tractor loaders is described which can be adjusted to fit various tractors. The apparatus comprises first and second tower members having side frame members extending forwardly therefrom. Each of the side frame members has a downwardly extending forward end portion having a cylindrical portion thereon. A length-adjustable and selectively rotatable cross member is connected to the cylindrical portions of the side frame members and is adapted to be secured to the forward end of the tractor. The lower ends of the tower members are adapted to be secured to opposite sides of the tractor. A boom assembly is pivotally connected to the upper ends of the tower members and extends forwardly therefrom and is adapted to have a materials handling attachment secured to the forward end thereof. A ball joint connects the booms to the tower members so that the tower members may be angled with respect thereto to permit the side frame members to be moved towards each other and away from each other depending upon the particular tractor on which the loader is being mounted.

Therefore, a principal object of the invention is to provide an adjustable tower for front end tractor loaders.

A further object of the invention is to provide a front end tractor loader which may be adjusted to permit the loader to be mounted on various types of tractors.

Still another object of the invention is to provide a front end tractor loader having a cross member at its forward end which may be longitudinally adjusted as well as rotatably adjusted to compensate for various types of tractors.

Still another object of the invention is to provide a front end tractor loader which has a ball joint connection between the boom and the tower members to permit the tower members to be angled with respect thereto.

Still another object of the invention is to provide a tractor loader which is economical of manufacture and durable in use.

These and other objects will be apparent to those skilled in the art.

DESCRIPTION OF THE PREFERRED EMBODIMENT

Figure 1:
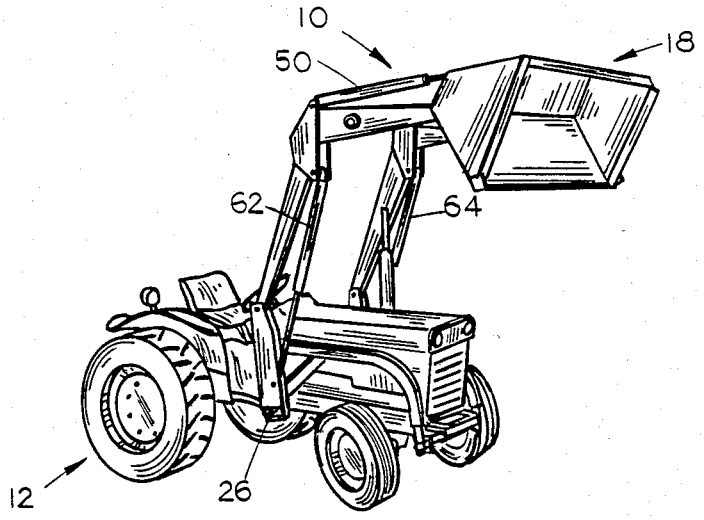
FIG. 1 is a front perspective view of the loader mounted on a tractor.
Figure 2:
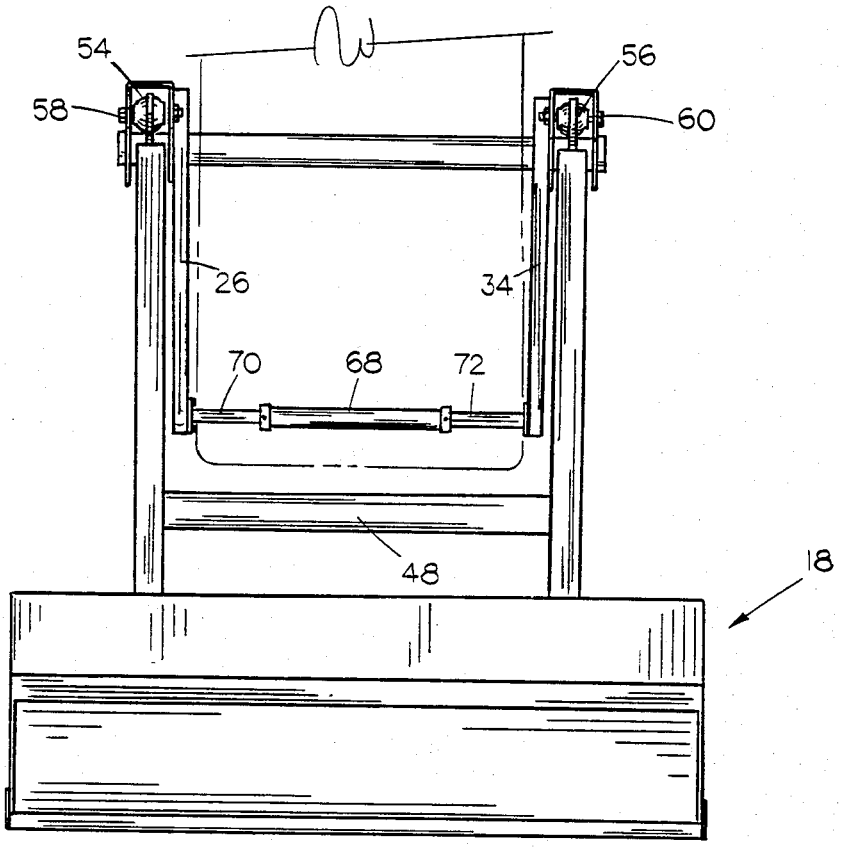
FIG. 2 is a top view of the loader, with the broken lines indicating a tractor.

The front end loader of this invention is referred to generally by the reference numeral 10 while the reference numeral 12 refers to a tractor upon which the loader is to be mounted. Generally speaking, the loader 10 includes a tower 14, boom 16, and materials-handling attachment 18 mounted on the forward end of the boom 16.

Figure 3:
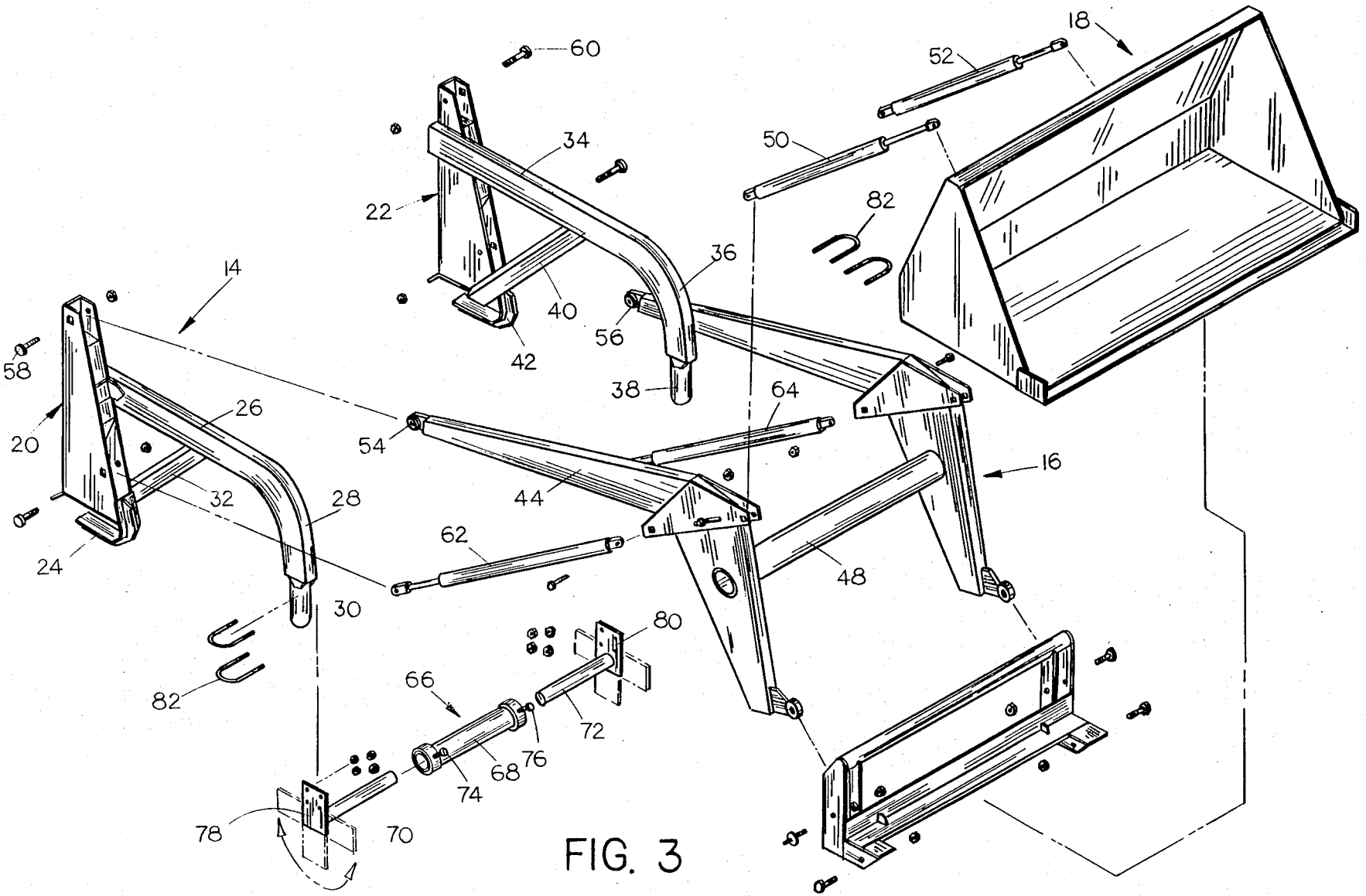
FIG. 3 is an exploded perspective view of the loader of this invention.

Tower 14 comprises a pair of spaced-apart tower members 20 and 22. Tower member 20 is provided with a connector element 24 at its lower end adapted to be secured to a bracket or the like on one side of the tractor and referred to generally by the reference numeral 26. Typical of the type of brackets to which the connector 24 would be secured is illustrated in U.S. Pat. No. 4,051,962. Side frame member 26 is welded at its rearward end to tower member 20 intermediate the ends thereof and extends forwardly therefrom as seen in the drawings. Side frame member 26 includes a downwardly extending forward end portion 28 having a cylindrical portion 30 at its lower end. Brace 32 extends between the tower member 20 and the side frame member 26 as illustrated in FIG. 3.

Tower member 22 likewise is provided with a forwardly extending side frame member 34 having a downwardly extending forward end portion 36 with cylindrical portion 38 at the lower end thereof. Brace 40 extends between tower member 22 and side frame member 34 as illustrated. Tower 22 has a connector element 42 at its lower end.

Boom assembly 16 includes spaced-apart booms 44 and 46 which are pivotally connected at their rearward ends to the upper ends of the tower members 20 and 22 as will be described in more detail hereinafter. Brace 48 is secured to and extends between the booms 44 and 46 for strengthening and stability purposes. Attachment 18 is mounted on the forward end of the booms 44 and 46 by any convenient means not forming a part of this invention. Cylinders 50 and 52 extend between the boom 16 and the attachment 18 for pivotally moving the attachment in conventional fashion. The pivotal connection between the rearward ends of the booms 44 and 46 is in the form of ball joints 54 and 56 having bolts 58 and 60 extending therethrough. The purpose of the ball joints is to permit the tower members 20 and 22 to be angled with respect to the booms 44 and 46 should the side frame members 26 and 34 need to be moved towards each other or away from each other to compensate for various tractor widths. Cylinders 62 and 64 connect the tower members with the booms to permit the booms to be raised and lowered with respect to the tower members.

The numeral 66 refers to a longitudinally adjustable cross member adapted to connect the forward ends of the side frame members 26 and 34 to the front end of the tractor. Cross member 66 comprises an elongated hollow pipe 68 having tubular members 70 and 72 received in its opposite ends. Tubular members 70 and 72 are selectively positioned within pipe 68 by means of the bolts or screws 74 and 76 threadably extending into the ends of the pipe 68 and adapted to engage the tubular members 70. Mounting plates 78 and 80 are secured to the outer ends of the tubular members 70 and 72 respectively and are provided with openings formed therein adapted to receive U-bolts 82 therein. As seen in the drawings, plates 78 and 80 are mounted adjacent one end to the outer ends of tubular members 70 and 72 and may be selectively rotated to the positions illustrated by broken lines in FIG. 3 to permit the cross member 66 to be selectively positioned for attachment to various tractor configurations. U-bolts 82 extend through the mounting plates 78 and 80 and embrace the cylindrical portions 30 and 38. Thus, it can be seen that the tubular members 70 and 72 may be moved outwardly with respect to pipe 66 to compensate for wider tractors and may be moved inwardly into the pipe 68 to compensate for narrow tractors. Further, the tubular members 70 and 72 may be selectively rotated to permit the pipe 68 to be positioned forwardly, rearwardly, upwardly, or downwardly, depending on the particular orientation of the mounting plates.

The ball joint connection between the tower members and the booms permits the forward ends of the side frame members 26 and 34 to be moved inwardly towards each other and outwardly away from each other without affecting the operation of the booms. The adjustable feature of the cross member permits the loader to be mounted on various types of tractors. The cross member 66 is received in a bracket at the forward end of the tractor not forming a part of this invention. A further advantage of the loader of this invention is that it may be broken down into small component parts for shipment.

Thus it can be seen that the loader of this invention accomplishes at least all of its stated objectives.

We claim:

1. An adjustable tower for front end tractor loaders comprising, first and second tower members having upper and lower ends, said first and second tower members having connection means at their lower ends for connection to opposite sides of the tractor, said first tower member having a first elongated frame member secured at its rearward end thereto and extending forwardly therefrom, said first frame member having a downwardly extending forward end portion, said second tower member having a second elongated frame member secured at its rearward end thereto and extending forwardly therefrom, said second frame member having a downwardly extending forward end portion, a length-adjustable cross member secured to said downwardly extending forward end portions on said first and second frame members and extending therebetween for connection to the forward end of the tractor, first and second booms pivotally secured at their rearward ends to the upper ends of said first and second tower members respectively, and extending forwardly therefrom, first and second hydraulic cylinders connecting said booms and tower members for pivotally moving said booms with respect to said tower members, the forward ends of said booms adapted to receive a materials-handling attachment thereon, said length-adjustable cross member comprising a hollow pipe having tubular members selectively longitudinally received in its opposite ends, the outer ends of said tubular members being operatively secured to said downwardly extending forward end portions of said frame members, and a flat mounting plate secured to the outer end of each of said tubular members, said tubular members being selectively rotatably secured to said pipe to permit said mounting plates to be selectively positioned, said downwardly extending forward end portions being secured to said mounting plates.

2. The apparatus of claim 1 wherein said downwardly extending forward end portions are cylindrical and wherein U-bolts connect said forward end portions to said mounting plates.

3. An adjustable tower for front end tractor loaders comprising, first and second tower members having upper and lower ends, said first and second tower members having connection means at their lower ends for connection to opposite sides of the tractor, said first tower member having a first elongated frame member secured at its rearward end thereto and extending forwardly therefrom, said first frame member having a downwardly extending forward end portion, said second tower member having a second elongated frame member secured at its rearward end thereto and extending forwardly therefrom, said second frame member having a downwardly extending forward end portion, first and second booms pivotally secured at their rearward ends to the upper ends of said first and second tower members respectively, and extending forwardly therefrom, first and second hydraulic cylinders connecting said booms and tower members for pivotally moving said booms with respect to said tower members, the forward ends of said booms adapted to receive a materials-handling attachment thereon, ball joints pivotally connecting said booms to said tower members to permit the forward ends of said frame members to be moved towards and away from each other, and a length adjustable cross member secured to said downwardly extending forward end portions on said first and second frame members and extending therebetween for connection to the forward end of the tractor, said cross member including selectively rotatable adjustment means at its opposite ends to permit said cross member to be selectively moved forwardly, rearwardly, upwardly and downwardly with respect to said forward end portions and tractor.

* * * * *